US007261142B2

(12) United States Patent
Kawahara et al.

(10) Patent No.: US 7,261,142 B2
(45) Date of Patent: Aug. 28, 2007

(54) HEAT PIPE EXCELLENT IN REFLUX CHARACTERISTIC

(75) Inventors: Youji Kawahara, Tokyo (JP); Masataka Mochizuki, Tokyo (JP); Koichi Mashiko, Tokyo (JP); Fumitoshi Kiyooka, Kanagawa (JP); Hiroaki Agata, Kanagawa (JP)

(73) Assignees: Fujikura, Ltd., Tokyo (JP); International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/777,061

(22) Filed: Feb. 13, 2004

(65) Prior Publication Data

US 2004/0177946 A1 Sep. 16, 2004

(30) Foreign Application Priority Data

Feb. 17, 2003 (JP) ..... 2003-038404

(51) Int. Cl.
*F28D 15/00* (2006.01)
*H05K 7/20* (2006.01)

(52) U.S. Cl. ..... 165/104.26; 165/104.21

(58) Field of Classification Search ..... 165/104.26, 165/104.21, 104.33, 80.4, 185; 361/699, 361/700; 174/15.2; 257/714–716; 29/890.032
See application file for complete search history.

(56) References Cited

U.S. PATENT DOCUMENTS 3,680,189 A * 8/1972 Noren ..... 29/890.032
3,734,173 A * 5/1973 Moritz ..... 165/104.26
3,811,493 A * 5/1974 Bilinski et al. ..... 165/272
3,901,311 A * 8/1975 Kosson et al. ..... 165/104.26
4,018,269 A * 4/1977 Honda et al. ..... 165/104.26
4,021,816 A * 5/1977 Peck ..... 343/840
4,046,190 A * 9/1977 Marcus et al. ..... 165/104.26
4,116,266 A * 9/1978 Sawata et al. ..... 165/104.26
4,169,387 A * 10/1979 Krempl ..... 73/708
4,196,504 A * 4/1980 Eastman ..... 29/890.32
4,212,347 A * 7/1980 Eastman ..... 165/46
4,274,479 A * 6/1981 Eastman ..... 165/104.26
4,489,777 A * 12/1984 Del Bagno et al. ..... 165/104.26
4,883,116 A * 11/1989 Seidenberg et al. .... 165/104.26
5,465,782 A * 11/1995 Sun et al. ..... 165/104.26
5,642,776 A * 7/1997 Meyer et al. ..... 165/104.26
5,785,088 A * 7/1998 Pai ..... 138/38

(Continued)

FOREIGN PATENT DOCUMENTS

JP 3067399 1/1994

(Continued)

*Primary Examiner*—Tho Duong
(74) *Attorney, Agent, or Firm*—Sughrue Mion, PLLC

(57) ABSTRACT

A heat pipe wherein a condensable liquid phase working fluid is encapsulated in a container sealed in air-tight condition; wherein the wick composed of the porous body for refluxing the liquid phase working fluid by a capillary pressure is provided in the container; wherein a part of the container functions as an evaporating part for evaporating the working fluid by means of inputting the heat from outside; and wherein another part of the container functions as a condensing part for condensing a vapor of the working fluid by means of radiating the heat to the outside; comprises a direct reflux flow passage for flowing the liquid phase working fluid to the evaporating part, which has a flow cross-sectional area greater than that of a cavity formed in the porous body.

8 Claims, 5 Drawing Sheets

U.S. PATENT DOCUMENTS 6,056,044 A * 5/2000 Benson et al. ..... 165/104.26
6,210,042 B1 * 4/2001 Wang et al. ..... 384/317
6,212,074 B1 4/2001 Gonsalves et al.
6,227,287 B1 * 5/2001 Tanaka et al. ..... 165/80.4
6,293,333 B1 * 9/2001 Ponnappan et al. .... 165/104.26
6,382,309 B1 * 5/2002 Kroliczek et al. ..... 165/104.26
6,397,935 B1 * 6/2002 Yamamoto et al. .... 165/104.26
6,490,160 B2 12/2002 Dibene, II et al.
6,504,721 B1 1/2003 Watwe et al.
6,650,544 B1 * 11/2003 Lai ..... 361/700
6,766,817 B2 7/2004 da Silva
6,901,994 B1 * 6/2005 Jin-Cherng et al. .... 165/104.26

FOREIGN PATENT DOCUMENTS

JP 2794154 4/1995

* cited by examiner

HEAT PIPE EXCELLENT IN REFLUX CHARACTERISTIC

BACKGROUND OF THE INVENTION

1. Field of the Invention

The present invention relates to a heat pipe for transporting heat as latent heat of a working fluid such as a condensable fluid, and especially to a heat pipe which is constructed to create a so-called pumping force for refluxing a liquid phase working fluid to a portion where it evaporates, by means of a capillary pressure of a porous material.

The present invention relates to the subject matter contained in Japanese Patent Application No.2003-38404, filed on Feb. 17, 2003, which is expressly incorporated herein by reference.

2. Related Art

In the customary way, a heat pipe for transporting heat in the form of latent heat of a working fluid is well known in the prior art. The heat pipe of this kind is a heat conducting element encapsulating a condensable fluid such as water in a sealed receptacle (container) after evacuating an air therefrom, and which is constructed to transport the heat as latent heat of a working fluid by evaporating the working fluid with the heat inputted from outside, and by condensing a vapor by radiating the heat after the vapor flows to a condensing part of a low temperature and a low pressure. Accordingly, since the heat is transported in the form of latent heat of the working fluid, the heat pipe has more than ten times to several hundred times of heat transporting capacity in comparison with that of copper which is known to have the highest heat conductivity.

According to the heat pipe of this kind, the heat is transported by means of flowing the evaporated vapor phase working fluid to the condensing part in the low temperature and low pressure side, and after the heat transportation, the condensed liquid phase working fluid is refluxed to the evaporating part (i.e., a heat inputting part) by a capillary pressure of a wick.

The wick is, in short, a member for creating a capillary pressure, and therefore, it is preferable to be excellent in so-called hydrophilicity with the working fluid, and it is preferable to have its effective radius of a capillary tube as small as possible at a meniscus formed on a liquid surface of the liquid phase working fluid. In this connection, a porous sintered compact or a bundle of extremely thin wires is employed as a wick generally in the customary way. Among those wick members according to the prior art, the porous sintered compact may create great capillary pressure i.e., a pumping force to the liquid phase working fluid, because the opening dimensions of its cavities are smaller than that of other wicks. Also, the porous sintered compact may be formed into a seat shape so that it may be employed easily on a flat plate type heat pipe or the like called as a vapor chamber, which has been attracting attention in recent days. Accordingly, the porous sintered compact is a preferable wick material in light of those points of view.

The heat transporting characteristics of the heat pipe including the vapor chamber is thus improved as a result of an improvement of a wick material and so on, and miniaturization is also attempted in connection with this. At the same time, how to cool a personal computer, a server, or a portable electronics device, which are enhanced in its compactness and capacity, has been becoming a problem in recent days. The heat pipe has been garnering the attention as a means for solving this problem, and it has been employed more frequently. Examples of employing such downsized and thin-shaped heat pipe are disclosed in Japanese Patent Nos. 2,794,154 and 3,067,399.

As described above, it is possible to increase the capillary pressure for refluxing the liquid phase working fluid if a porous body is employed as a wick to be built into the heat pipe. This is advantageous for downsizing the heat pipe (or the vapor chamber). If the liquid phase working fluid is refluxed by utilizing the pumping force of the capillary pressure, the liquid phase working fluid is carried inside of the wick; however, in case of the wick of a porous body, because a flow path created therein is the cavity created among the fine powders as the material of a porous body, so that the flow cross-sectional area of the flow path has to be small and as intricate as a maze. Therefore, there is a disadvantage in that the flow resistance is relatively big. Also, the liquid phase working fluid is to be contained in the cavity so that an amount of the working fluid is not always sufficient. Accordingly, if the inputted amount of heat from outside increases suddenly and drastically, for example, there will be a possibility of so-called drying out such that the wick goes into a dry state due to a shortage of the liquid phase working fluid fed to the portion where the evaporation of the working fluid takes place.

Moreover, in general, the porous body to be employed as the wick is produced by sintering the fine powder material, so that there is no particular bias on a void content and it is uniformally even. If the wick of the porous body is moistened by the working fluid, the liquid phase working fluid disperses almost uniformly over the entire part of the wick. Since this is likewise exemplified even when the heat pipe is under operation, the liquid phase working fluid is dispersed and contained even in the portion where the heat is not inputted from outside, in case of the vapor chamber wherein the sheet-shaped porous body is employed as the wick. Consequently, this causes a reduction of the reflux rate or feeding amount of the liquid phase working fluid, to the portion where the heat is inputted from outside. Accordingly, there is room for improvement from this point of view.

SUMMARY OF THE INVENTION

The present invention has been conceived in view of the aforementioned technical problems and its object is to provide a heat pipe which can further improve a heat transporting capacity by promoting reflux of a liquid phase working fluid of a heat pipe wherein a porous body is employed as a wick.

According to the present invention, there is provided a heat pipe; wherein a condensable, liquid phase working fluid is encapsulated in a container sealed in an air-tight condition; wherein a wick composed of a porous body for refluxing the liquid phase working fluid by a capillary pressure is provided in the container; wherein a part of the container functions as an evaporating part for evaporating the working fluid by means of inputting the heat from outside; and wherein another part of the container functions as a condensing part for condensing a vapor of the working fluid by means of radiating the heat to the outside; comprises a direct reflux flow passage for flowing a condensable, liquid phase working fluid to the evaporating part, which has a flow cross-sectional area greater than that of a cavity formed in the porous body.

According to the heat pipe of the present invention, therefore, flow of the condensable, liquid phase working fluid toward the evaporating part takes place not only in the cavity of the porous body but also in the direct reflux flow passage in the porous body, and the flow cross-sectional area of the direct reflux flow passage is large, and the flow resistance is small in comparison with that of the porous body. Accordingly, the reflux of the liquid phase working fluid to the evaporating part is promoted and the amount of the evaporation of the working fluid at the evaporating part is increased, thereby increasing the heat transport of the heat pipe as a whole. Also, since the direct reflux flow passage functions as a reservoir portion for reserving the liquid phase working fluid, the amount of the working fluid contained in the evaporating part or in its vicinity is increased. As a result, shortage of condensable, liquid phase working fluid will not occur even when the inputted amount of heat is increased, and drying out is thereby prevented or suppressed in advance.

Besides, the direct reflux flow passage according to the present invention may be constructed of a plurality of flow paths extending from the evaporating part to a plurality of portions on the condensing part side.

In this case, the direct reflux flow passage which contributes to the reflux of the liquid phase working fluid is arranged by connecting a plurality of portions of condensing part side to the evaporating part, so that the liquid phase working fluid refluxes from a plurality of portions of the condensing part side to the evaporating part, and is reserved in sufficient amount in the evaporating part where the heat is inputted from outside or in the vicinity of the evaporating part. Accordingly, a disadvantage such as drying out caused by an increase in the inputted amount of heat is prevented or suppressed in advance.

Moreover, according to the present invention, it is possible to construct the direct reflux flow passage of a thin slit, or thin slits, formed on the surface of the porous body.

Furthermore, according to the present invention, the direct reflux flow passage may be formed between the porous body and an inner face of the container wherein the porous body is mounted.

In this case, the direct reflux flow passage may be formed into the thin slit, or the thin slits, or into a through passage, or through passages, between the inner face of the container and the porous body. Accordingly, the liquid phase working fluid refluxes to the evaporating part through the direct reflux flow passage, so that the flowage is smoothened and reflux rate is thereby increased. Therefore, the heat transporting capacity of the heat pipe as a whole is improved.

The above and further objects and novel features of the invention will more fully appear from the following detailed description when the same is read with reference to the accompanying drawings. It is to be expressly understood, however, that the drawings are for purpose of illustration only and are not intended as a definition of the limits of the invention.

DESCRIPTION OF THE PREFERRED EMBODIMENTS

Figure 1:
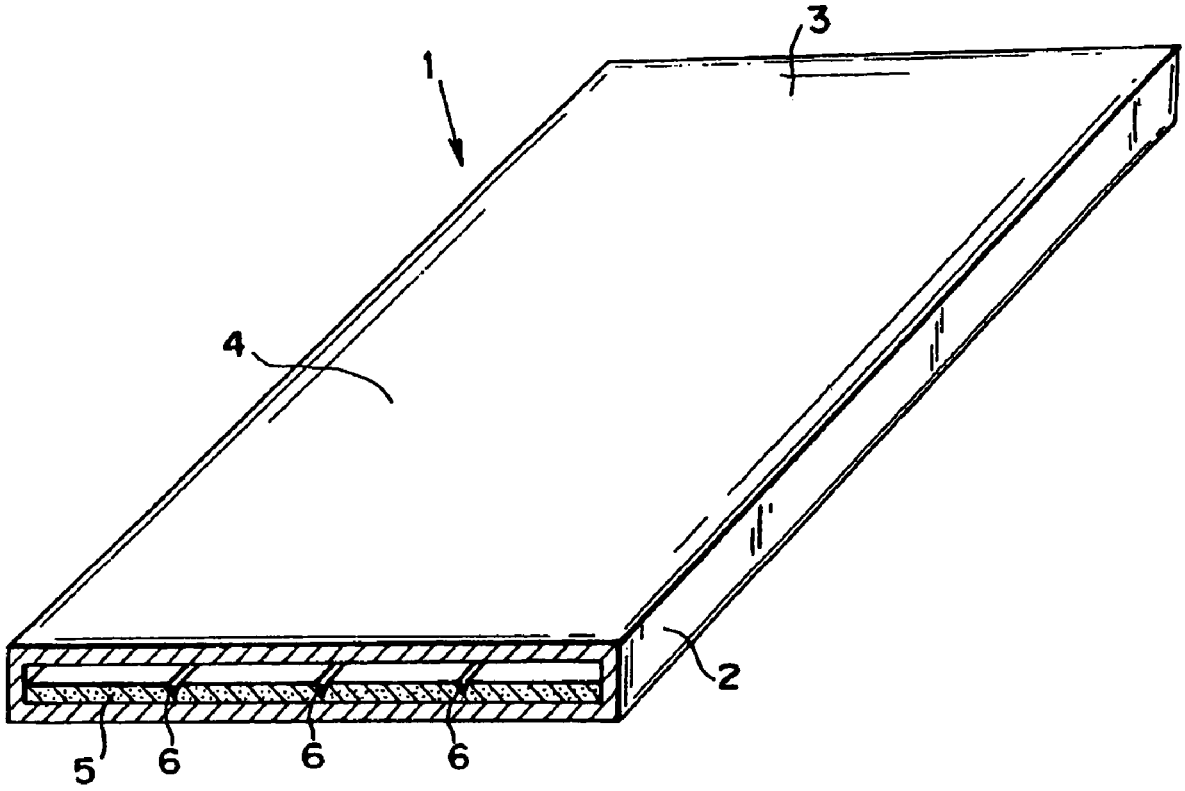
FIG. 1 is a partial cross-sectional perspective view showing one specific example of the present invention.

Here will be described the specific embodiments of the present invention with reference to the accompanying drawings. FIG. 1 shows one example of the heat pipe (or the vapor chamber) according to the present invention, and the heat pipe shown therein is constructed to be the flat thin-shaped type. Namely, a container 2 of the flat thin-shaped type heat pipe 1 is constructed to have a flat thin-shaped cross section. The inside of the container 2 is vacuum de-aerated and a condensable, liquid phase working fluid such as pure water, alcohol or the like is encapsulated therein. Here, for example, the encapsulating amount of the working fluid may be governed by: (Volume of wick× porosity+predetermined value $\alpha$). One of the end portions of the flat thin-shaped type heat pipe 1 thus constructed is an evaporating part 3, and another end portion is a condensing part 4.

A wick 5 is arranged on the bottom face of the container 2. This wick 5 is a porous sintered compact, and its material is copper powder or ceramic powder. It is formed into sheet shape and sintered to have a predetermined porosity. A plurality of reflux flow passages 6 is formed on the surface of the wick 5.

Figure 2:
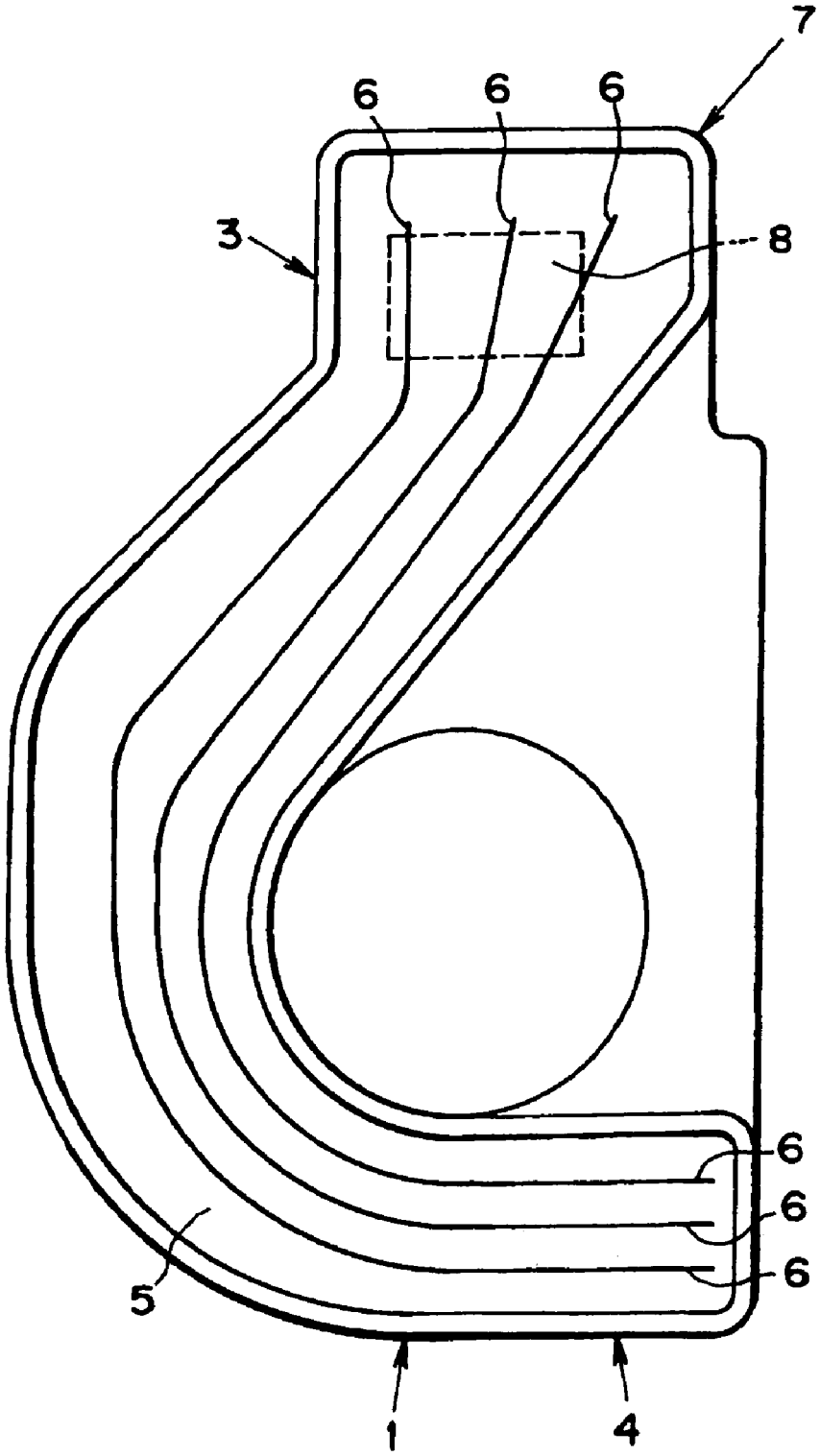
FIG. 2 is a plan view schematically showing a reflux flow passage according to the present invention.

One example of the reflux flow passage 6 is shown in FIG. 2 schematically. The example shown in FIG. 2 employs the aforementioned flat thin-shaped type heat pipe 1 as a cooling device 7 for an exothermic element 8 such as an electron device, and the heat pipe 1 is shown in FIG. 2 with its upper face dismantled to expose its inside. This heat pipe 1 is curved entirely as ancyroid. One of the end portions (i.e., the upper end portion in FIG. 2) is the evaporating part 3, and the exothermic element 8 is contacted or joined to the evaporating part 3 in a heat transmittable manner. On the other hand, another end portion (i.e., the lower end portion in FIG. 2) is the condensing part 4, where the heat is radiated outside to condense the working fluid.

The sheet shaped porous body is laid to be the wick 5 on the inner face of the heat pipe 1 shown in FIG. 2, and a plurality of reflux flow passages 6 (three lines in FIG. 2) is formed generally in parallel with each other. This reflux flow passage 6 is a thin slit, or thin slits, of 0.2 mm width and 0.5 mm depth for example, the cross section thereof is a triangular shape, and formed entirely from the evaporating part 3 to the condensing part 4. Also, the reflux flow passage 6 is made to have a greater flow cross-sectional area than that of the cavity in the porous body which forms the wick 5, or that of the flow passage formed by the cavity. Here, all of the reflux flow passages 6 are not necessarily to be formed from the evaporating part 3 to the condensing part 4, but may be formed extending from the plurality of portions of the condensing part 4 side to the evaporating part 3. Also, a clearance between the reflux flow passages 6 on the evaporating part 3 side is wider than that on the condensing part 4 side in connection with that the width of the wick 5 is wider on the evaporating part 3 side, in order to arrange the reflux flow passages 6 evenly in the width direction of the wick 5. Also, a clearance between the thin slits in the width direction of the porous body changes flexibly in accordance with the width of the porous body.

Next, an action of the aforementioned embodiment will be described hereinafter. First, the heat is transferred from the exothermic element 8 to the end portion functioning as the evaporating part 3. The working fluid in the container 2 evaporates when the heat is transferred to the evaporating part 3, and its vapor flows to the condensing part 4 side where the temperature and the pressure is low. Then, the heat belongs to the working fluid is dispersed at the condensing part 4 and the working fluid is condensed and liquefied. After that, the liquefied working fluid is refluxed to the evaporating part 3 side by the capillary action of the wick 5. Since so-called direct reflux flow passages 6 having a large flow cross-sectional area and a small flow resistance is provided in the container 2 from the evaporating part 3 to the condensing part 4, the amount of the working fluid refluxing to the evaporating part 3 larger than that of passing through only the porous wick 5. Namely, the reflux performance of the liquid phase working fluid to the evaporating part 3 is improved according to the aforementioned heat pipe 1.

The liquid phase working fluid not only interpenetrates into the wick 5 but also remains in the reflux flow passages 6 to be contained. Therefore, the containing amount of the liquid phase working fluid at the evaporating part 3 becomes large. Accordingly, the drying out such that the wick 5 is dried completely at the evaporating part 3 may be prevented even when the input amount of the heat from the exothermic element 8 increases drastically.

Figure 3:
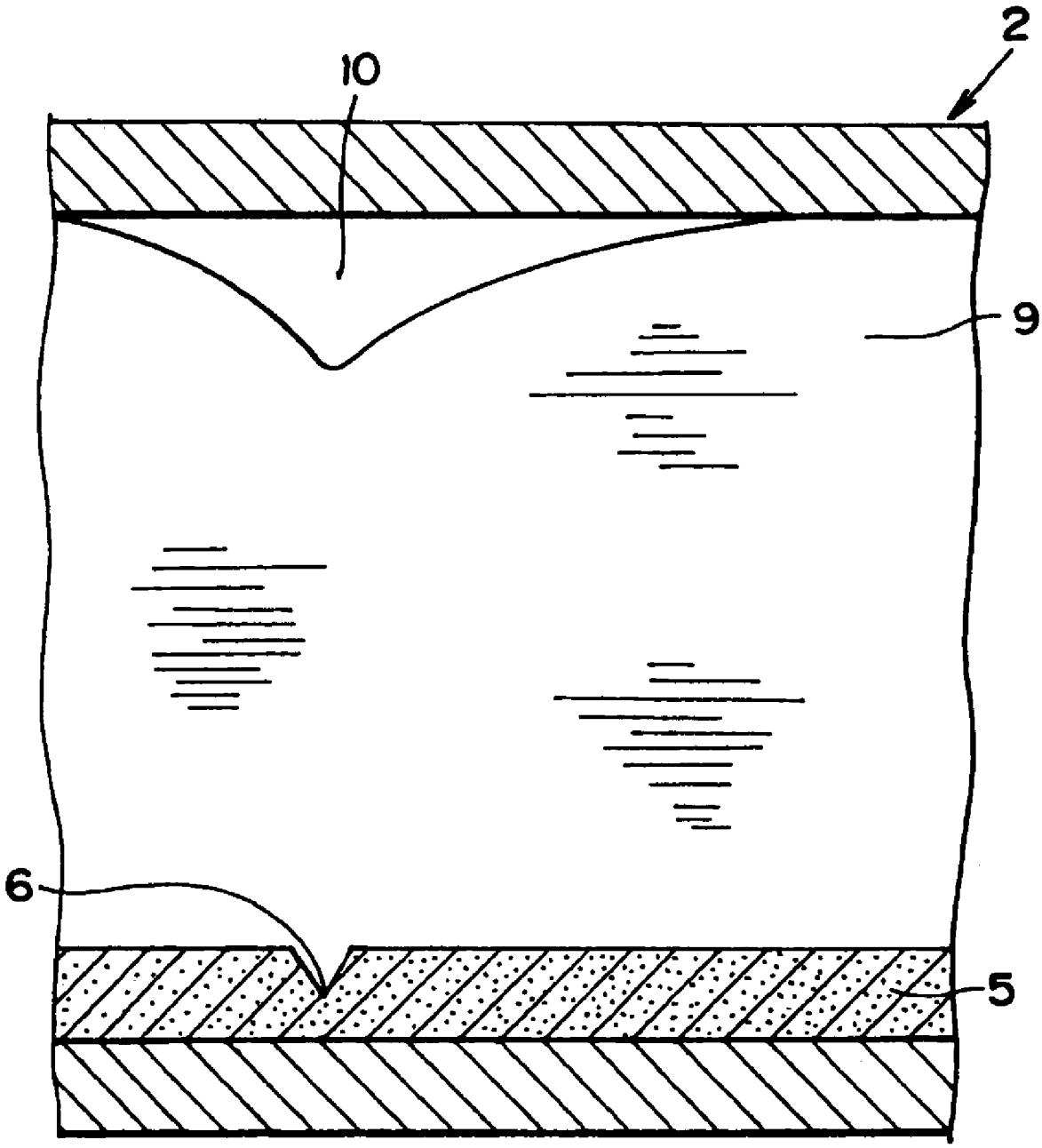
FIG. 3 is a cross-sectional view schematically showing the reflux flow passage and a status of a working fluid.

On the other hand, condensation of the working fluid occurs continuously at the condensing part 4 by means of radiating the heat to outside. Consequently, the amount of the liquid phase working fluid 9 becomes relatively large. Also, the container 2 is formed into flat thin-shape according to the heat pipe 1 shown in FIGS. 1 and 2, so that it is easy for the liquid phase working fluid 9 to saturate the whole space inside of the container 2 at the portion of condensing part 4 side. However, according to the heat pipe 1 of the present invention, there are provided the reflux flow passages 6 so that the refluxing of the liquid phase working fluid 9 to the evaporating part is promoted. Consequently, as shown in FIG. 3 for example, a dent is created, or dents, in the liquid surface of the liquid phase working fluid 9 at the portion corresponding to the reflux flow passages 6, and a vapor flow passage 10 is secured therein, or vapor flow passages. Accordingly, the vapor of the working fluid generated by being heated at the evaporating part 3 contacts with the inner face of the container 2 through the vapor flow passage 10, and the radiation of the heat is thereby promoted. The heat transport by the working fluid from the evaporating part 3 to the condensing part 4 is also promoted in this respect, and heat transporting characteristics of the heat pipe as a whole are thereby improved.

Additionally, an experiment devised by inventors of the present invention proved that a temperature rise at the evaporating part is suppressed, and the thermal resistance was improved approximately 20 percent in the example of providing the reflux flow passage 6, as compared to the example in which the reflux flow passage 6 is not provided, provided that the inputted heat to the evaporating part 3 was 25 to 45 W (watt).

Figure 4:
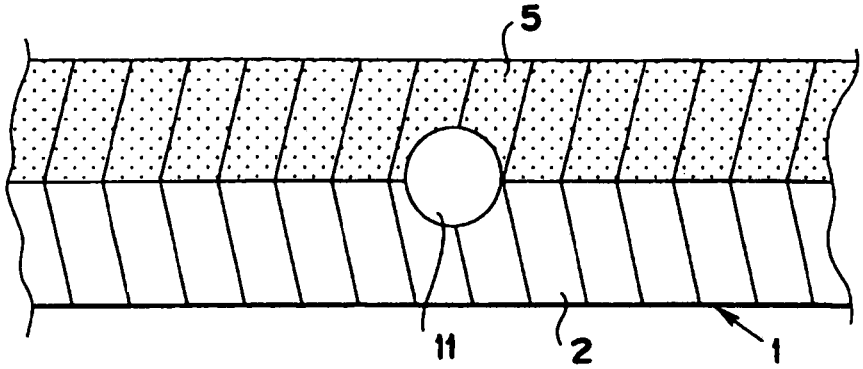
FIG. 4 is an expanded sectional view schematically showing one example of configuration of the reflux flow passage according to the present invention.
Figure 5:
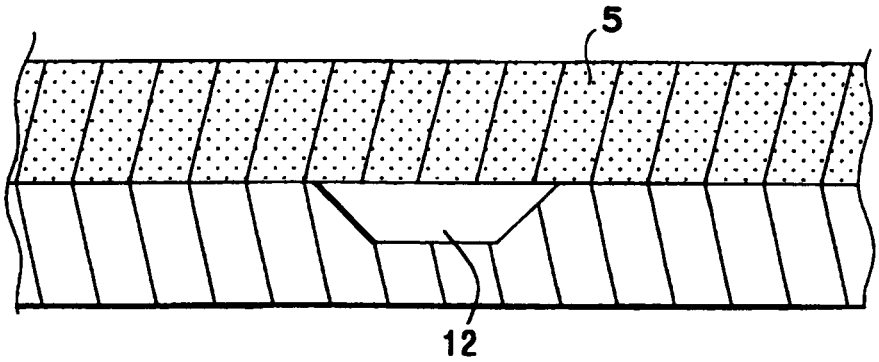
FIG. 5 is an expanded sectional view schematically showing another example of configuration of the reflux flow passage according to the present invention.
Figure 6:
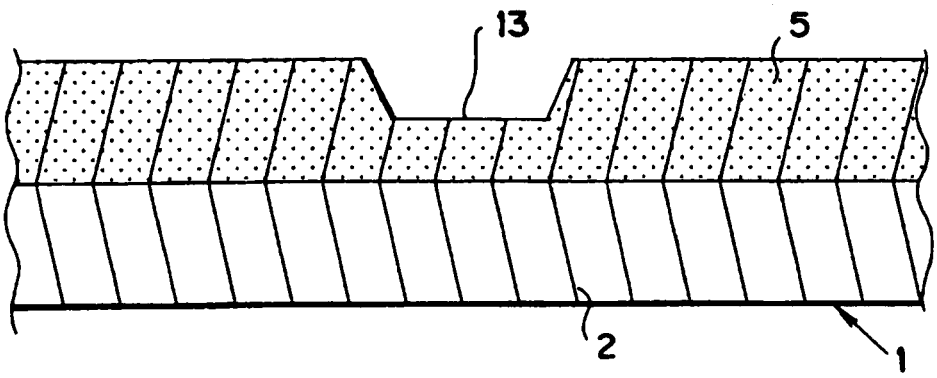
FIG. 6 is an expanded sectional view schematically showing still another example of configuration of the reflux flow passage according to the present invention.

Other examples of the reflux flow passage according to the present invention are shown FIGS. 4 to 6. The direct reflux flow passage according to the present invention is, in short, the passage for flowing the liquid phase working fluid to the evaporating part and functions together with the wick composed of the porous body, so that the location and the shape are not limited to the aforementioned examples if it fulfills its application or its function. In FIG. 4, for example, reflux flow passage 11 is formed between the wick 5 and the inner face of the container 2 where the wick 5 is mounted, and the sectional shape of the reflux flow passage 11 is in a circular form. The reflux flow passage 11 of this shape may be constructed as a passage of a circular cross-section by combining slits of semicircular cross-section on both the wick 5 and the container 2, otherwise, by holing on either wick 5 or container 2.

Also, the direct reflux flow passage according to the present invention may be in an arbitrary sectional shape. For example, the sectional shape of the reflux flow passage 12 between the wick 5 and the container 2 may be formed into a trapezoid as shown in FIG. 5, otherwise, the sectional shape of the reflux flow passage 13 formed on the surface of the wick 5 may be formed into a trapezoid as shown in FIG. 6. Thus, the reflux flow rate of the liquid phase working fluid may be adjusted to the specification and the design of the flat thin-shaped type heat pipe, by means of modifying the sectional shape or arranging the position of the reflux flow passage. Consequently, it is possible to further improve the heat transporting capacity of the flat thin-shaped type heat pipe according to the present invention. Besides, the cross-sectional shape of the reflux flow passage according to the present invention may be formed into an adequate shape such as a semicircle, a square or the like other than the examples mentioned above.

Figure 7:
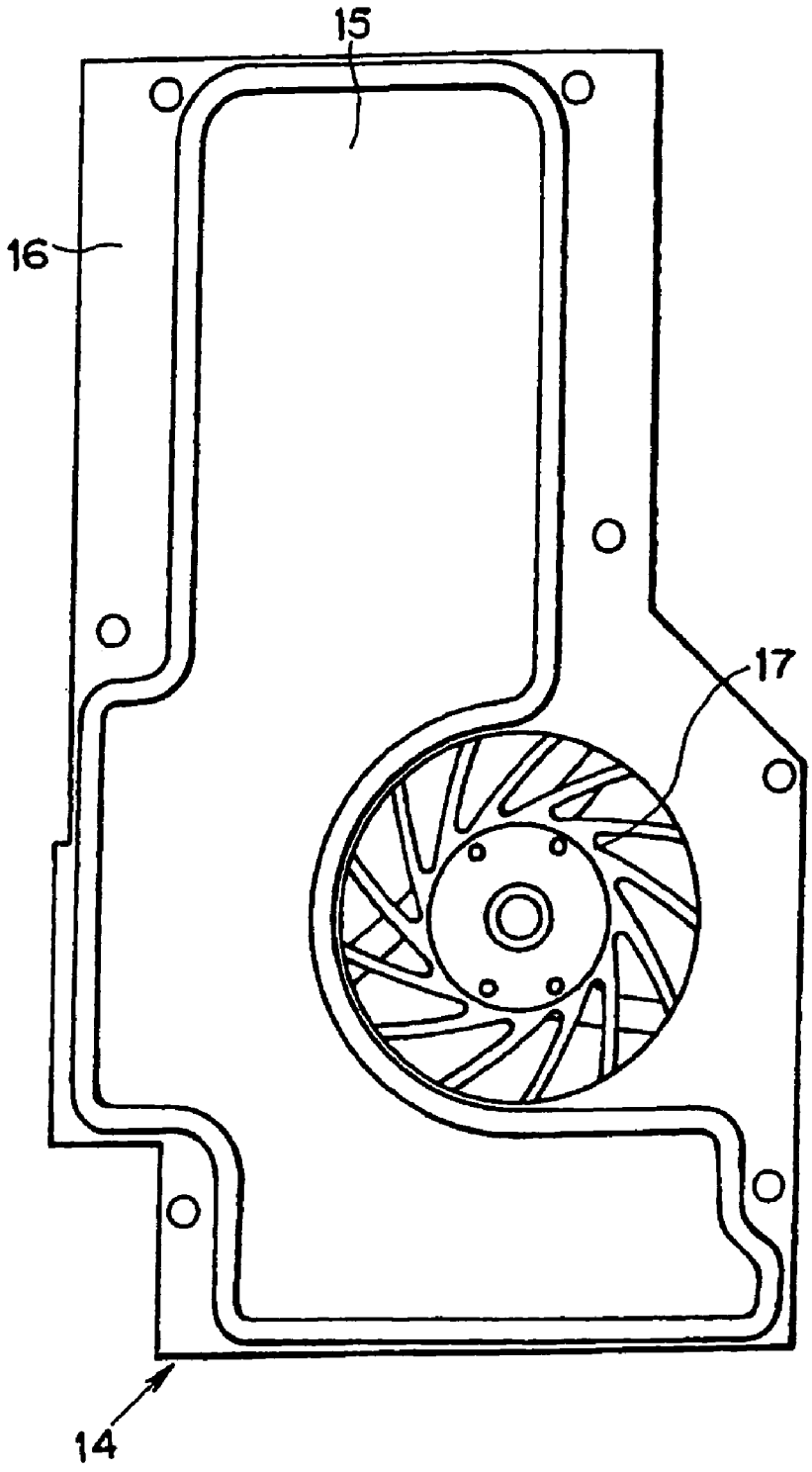
FIG. 7 is a plan view showing an example of employing a flat thin shaped heat pipe according to the present invention as a cooling device.

An example of employing the flat thin-shaped type heat pipe according to the present invention as the cooling device is shown in FIG. 7. An upper face portion of a cooling device 14 in FIG. 7 is an L-shaped, flat, thin-shaped type heat pipe 15. The construction of the wick and the reflux flow passage in this flat thin-shaped type heat pipe 15 are equivalent or identical to that of the aforementioned flat thin-shaped type heat pipe 1.

In the cooling device 14, the flat thin-shaped type heat pipe 15 and a fan 17 are joined to a frame 16. The aforementioned heat pipe 15 which is excellent in reflux characteristics and heat transporting capacity is employed in the cooling device 14, so that the heat of the exothermic element, not shown, may be transported to the vicinity of the fan 17 efficiently. Consequently, the cooling efficiency of the cooling device 14 as a whole is improved.

The advantages to be attained by the present invention are described below. According to the present invention, as has been described hereinbefore, the flow of the condensable, liquid phase working fluid toward the evaporating part takes place not only at the cavity but also at the direct reflux flow passage inside of the porous body, and the flow cross-sectional area of the direct reflux flow passage is large and the flow resistance is small in comparison with that of the porous body. Accordingly, the reflux of the liquid phase working fluid to the evaporating part is promoted and the amount of evaporation of the working fluid at the evaporating part is increased, thereby increasing the amount of heat transport of the heat pipe as a whole. Also, since the direct reflux flow passage functions as the reservoir portion for reserving the liquid phase working fluid, the containing amount of the liquid phase working fluid is increased in the evaporating part or in its vicinity. Consequently, a shortage of the liquid phase working fluid is prevented even when the inputted amount of heat is increased, and additionally, drying out is thereby prevented or suppressed in advance.

Moreover, according to the present invention, the direct reflux flow passage which contributes to the reflux of the liquid phase working fluid is arranged by joining a plurality of portions in the condensing part side and the evaporating part, so that the liquid phase working fluid refluxes from a plurality of portions in the condensing part side to the evaporating part. Accordingly, the liquid phase working fluid may be reserved in a sufficient amount in the evaporating part where the heat is inputted from the outside or in its vicinity, and the disadvantage such as drying out caused by increase of the inputted amount of heat may be prevented or suppressed in advance.

Furthermore, according to the present invention, the condensable, liquid phase working fluid refluxes to the evaporating part through the direct reflux flow passage which is formed as a thin slit or formed between the porous body and the inner face of the container, and the flowage is smoothened to increase the reflux flow rate. Therefore, the heat transporting capacity of the heat pipe as a whole may be increased.

What is claimed is:

1. A heat pipe comprising a condensable, liquid phase working fluid encapsulated in a container sealed in an air-tight condition and a wick provided in the container composed of a porous body sheet for refluxing the condensable, liquid phase working fluid by a capillary pressure to an evaporating part of the container, in which a part of the container functioning as the evaporating part for evaporating the condensable, liquid phase working fluid by means of inputting heat from outside, and in which another part of the container functions as a condensing part for condensing a vapor of the condensed working fluid by means of radiating heat to the outside:

wherein the container is constructed to have a flat thin-shaped section comprising a top face and a bottom face;

wherein the porous body sheet is arranged on the bottom face of the container;

wherein a direct reflux flow passage has a flow cross-sectional area greater than that of a cavity formed in a wick, the direct reflux flow passage is formed from the condensing part to the evaporating part in the container and the direct reflux flow passage is formed between the porous body sheet and an inner face of the container where the porous body sheet is mounted;

wherein the direct reflux flow passage is formed on the inner face of the container and the porous body sheet is mounted thereon to close an opening of the direct reflux passage;

wherein the direct reflux flow passage includes a thin slit or thin slits formed on the surface of the porous body sheet; and wherein a clearance between the thin slits in the width direction of the porous body sheet changes flexibly in accordance with the change in width of the porous body sheet.

2. A heat pipe according to claim 1, wherein a cross-sectional shape of the direct reflux flow passage is selected from the group consisting of a triangular shape, a circular shape, a trapezoidal shape, a semicircular shape, and a square shape.

3. A heat pipe according to claim 1, wherein the encapsulating amount of the condensable liquid phase working fluid is governed by: (Volume of wick×porosity+predetermined value $\alpha$).

4. A heat pipe according to claim 1, wherein the wick is composed of a porous sintered compact and its material is copper powder or ceramic powder.

5. A heat pipe according to claim 1, wherein a part of the container functions as an evaporating part for evaporating the condensable, liquid phase working fluid by means of an exothermic element contacted or joined to the evaporating part in a heat transmittable manner.

6. A heat pipe according to claim 1, wherein the direct reflux flow passage includes a plurality of flow paths extending from the plurality of portions of the condensing part side to the evaporating part.

7. A heat pipe according to claim 1, wherein a direct reflux flow passage has a flow resistance less than that of a cavity formed in a wick composed of a porous body sheet.

8. A heat pipe according to claim 1, comprising a condensable, liquid phase working fluid encapsulated in a container sealed in an air-tight condition and a wick provided in the container composed of a porous body sheet for refluxing the condensable, liquid phase working fluid by a capillary pressure to an evaporating part of the container, in which a part of the container functions as the evaporating part for evaporating the condensable, liquid phase working fluid by means of inputting heat from outside, and in which another part of the container functions as a condensing part for condensing a vapor of the condensed working fluid by means of radiating heat to the outside;

wherein the container is constructed to have a flat thin-shaped section comprising a top face and a bottom face;

wherein the porous body sheet is arranged on the bottom face of the container;

wherein a direct reflux flow passage has a flow cross-sectional area greater than that of a cavity formed in a wick, the direct reflux flow passage is formed from the condensing part to the evaporating part in the container and the direct reflux flow passage if formed between the porous body sheet and an inner face of the container where the porous body is mounted;

wherein the direct reflux flow passage is formed on the inner face of the container and the porous body sheet is mounted thereon to close an opening of the direct reflux passage; and wherein a clearance between a plurality of flow paths on the evaporating part side is wider than that on the condensing part side in connection with that the width of the wick is wider on the evaporating part side, in order to arrange the reflux flow passages evenly in the width direction of the wick.

* * * * *